United States Patent [19]

Tuten et al.

[11] Patent Number: 4,787,495

[45] Date of Patent: Nov. 29, 1988

[54] METHOD AND APPARATUS FOR SELECTIVE SCRAP METAL COLLECTION

[75] Inventors: William J. Tuten; Kennith D. Crosby, both of Scottsdale, Ariz.

[73] Assignee: Creative Technology, Inc., Scottsdale Ind. Air Park, Ariz.

[21] Appl. No.: 676,785

[22] Filed: Nov. 30, 1984

[51] Int. Cl.[4] ..... G07F 7/06; B07C 9/00

[52] U.S. Cl. ..... 194/209; 194/213; 100/902; 209/930

[58] Field of Search ..... 194/4 C, 4 R, 205, 208, 194/209, 211, 212, 213, 339, 340; 209/930, 592–595, 636; 100/902; 177/165, 50, 145; 222/77; 414/224; 198/642

[56] References Cited

U.S. PATENT DOCUMENTS

| | | | |
|---|---|---|---|
| Re. 27,643 | 5/1973 | Myers | 194/208 |
| 619,799 | 2/1899 | Skillin | 198/642 X |
| 740,453 | 10/1903 | Moebeck | 198/642 X |
| 1,782,996 | 11/1930 | Moody | 198/642 X |
| 3,749,240 | 7/1973 | Spears et al. | 209/636 X |
| 4,179,018 | 12/1979 | Miller | 194/4 R |
| 4,257,511 | 3/1981 | Miller | 100/902 X |
| 4,345,679 | 8/1982 | DeWoolfson | 194/209 |
| 4,402,391 | 9/1983 | Tuten et al. | 177/165 X |
| 4,463,844 | 8/1984 | Huffman et al. | 194/213 |
| 4,505,370 | 3/1985 | Swenck | 194/213 |
| 4,516,489 | 5/1985 | Ballo | 100/902 X |
| 4,532,859 | 8/1985 | Solordal | 194/212 X |
| 4,576,289 | 3/1986 | Jarrett et al. | 194/213 X |
| 4,597,487 | 7/1986 | Crosby et al. | 194/209 |

*Primary Examiner*—Joseph J. Rolla
*Assistant Examiner*—Edward S. Ammeen
*Attorney, Agent, or Firm*—Victor Flores

[57] ABSTRACT

A scrap metal collection system having apparatus for separating ferrous from non-ferrous material for which the weight exceeds a pre-determined amount and separating metallic materials from non-metallic materials. The resulting material remaining after these separations is typical aluminum cans. The cans are compacted by a crushing apparatus weighed and distributed in a storage area. Coins are returned to the operator of the apparatus determined by the weight and rounded to the nearest penny for the cumulative weight. Apparatus is disclosed for determining the excessively heavy material by allowing the excessively heavy material to fall and impact a plate. The separation of ferrous material has been implemented in a manner to avoid jamming of the conveyor belt. The distribution is of the compacted material in the storage compartment. Other improvements in the apparatus and in the control of the apparatus relative to prior scrap metal collection systems are described.

14 Claims, 5 Drawing Sheets

METHOD AND APPARATUS FOR SELECTIVE SCRAP METAL COLLECTION

BACKGROUND OF THE INVENTION

1. Field of the Invention

This invention relates generally to a method and apparatus for selectively recovering or collecting scrap metal having selected properties. More particularly, the present invention relates to a method and apparatus for segregating non-magnetic metal containers such as aluminum containers or cans from other deposited materials and for compensating depositors of such scrap metal based on the weight of the scrap metal so collected.

2. Description of the Related Art

Non-reusable, non-returnable metal containers or cans of various types are currently used to package many different types of foods and beverages and have become part of the American way of life. Many products, particularly soft drinks and malt cereal beverages, are provided to the consumer in metal cans. Aluminum cans or containers provide particular advantages because of the relatively light weight of aluminum. Aluminum's resistance to corrosion and food contamination is also an important characteristic, as is the fact that aluminum leaves no "tinny" taste. A further advantage of aluminum is that aluminum cans or lids can be provided with tear tabs, press tabs or pop tops making them even more convenient for use by the consumer and eliminating the need for can openers and the like. More than 60 billion aluminum cans are used each year. The growth of this market is 8 to 10 percent per year. Currently about 53 percent of aluminum cans are being recycled.

With rapid increase in the use of non-reusable, non-returnable metal containers, the problem of littering has become quite serious as anyone driving on America's highways can attest. Unfortunately, many consumers carelessly discard metal cans blighting the countryside, spoiling the scenery and costing governments large sums of money for clean-up and the like. Consumer groups, beverage industry groups, governmental groups and others have attempted to meet this problem by establishing recycling centers which compensate individuals for aluminum containers brought back to the recycling center. The returned aluminum cans can be recovered and refabricated into new cans thus reducing litter, saving about 95 percent of the energy spend in refining aluminum ore, and conserving aluminum metal as a natural resource. However, even the establishment of recycling centers has not completely alleviated the problem as many people still carelessly throw away or discard used containers.

Part of the problem lay in the fact that it was often necessary for the consumer to collect or save the cans for a long period of time before returning them to the recycling center. Since the price paid at the recycling center did not always compensate the driver for the cost of transportation unless a large number of cans were saved, saving or storing the cans between trips to the recycling center often became messy and sloppy as some liquid always managed to remain in the cans and somehow leaked through the storage bags, boxes or the like drawing flies and other insects, as well as causing an unsightly mess, stains, sticky spots, and the like.

Further attempts were made at having a return center closer to the consumer, and many grocery stores began accepting aluminum cans. However, the grocery stores ran into the same problems of leakage, storage space, mess, and man power required to implement the system, and hence the price payed for the recycled aluminum cans was less than it would otherwise have been.

Therefore, a need existed for a method and apparatus for receiving and processing metal containers and particularly aluminum cans which would be convenient to the consumer and provide the necessary incentives so that the consumers would be encouraged to collect and return empty containers in any given amount. Preferably, such apparatus would be located throughout the community at convenient locations such as parking lots and shopping malls and the like and would operate unattended to reduce cost and enable the collection apparatus or facility to pay fair compensation for aluminum containers and the like.

The first significant attempt to solve the problem is disclosed is U.S. Pat. No. Re. 27,643 issued to Joseph D. Myers. This patent discloses a method and apparatus for the collection of metal containers which automatically dispenses tokens for each non-magnetic container stored. The system, while effective, does not separate selected aluminum containers from general refuge and trash and extraneous material can cause the machine to jam or become inoperative. Further, compensation or tokens are dispensed in response to a county of non-magnetic containers rather than in relation to the weight of the selected metal recovered by the apparatus. There are many disadvantages to this type of approach.

The next step in the evolution of systems for selectively collecting scrap metal are best represented by U.S. Pat. Nos. 4,179,018 and 4,257,511 which issued to John H. Miller. These patents disclose method and apparatus in which non-returnable aluminum cans used to package soft drinks and malt cereal beverages are segregated from other material such as tin-plated steel cans that are deposited in the apparatus. A start button or switch is pushed by the depositor to start the operation of the apparatus and the deposited materials are conveyed by a conveyor belt to a magnetic separation portion of the apparatus to separate magnetic, ferrous materials such as tin-plated steel cans from the non-magnetic material and store the ferrous materials in a storage bin. However, non-magnetic materials are collected at the bottom of a pneumatic classifier conveyor which transports the aluminum, non-ferrous metal containers to a crusher. The materials so transported are crushed and weighed. After weighing, the crushed aluminum cans are conveyed by a pneumatic stacker conveyor and deposited into an inclined storage location at the top of the apparatus.

The apparatus of Miller is provided with a compensation dispenser which dipenses or disperses coins, tokens and other symbols of value, the amount of which is determined by the weight of the non-ferrous materials that pass through the crusher and are weighed by the weighing means during operation of the collection apparatus. This type of apparatus is designed to be used in an unattended mode and is frequently placed in parking lots or shopping centers, shopping malls, and the like where it is easy for persons, customers and consumers who patronize the retail stores to dispose of their collected aluminum cans while being paid therefor.

The recovered aluminum from this source saves energy and raw materials while simultaneously reducing the problems associated with the disposing of such cans after their contents have been consumed and greatly alleviating the litter problem. While the present price of tin-plated steel cans makes it almost impossible to compensate for them, their collection is of some intrinsic value insofar as cleaning up the environment is concerned. Notwithstanding, a depositor is notified that he will not be compensated for a tin-plated steel can, at least at the present time.

The next step in the evolution of selective scrap metal collection systems is set forth in U.S. Pat. No. 4,402,391 issued Sept. 6, 1983 and invented by the inventors of the present invention. This patent describes an improved method and apparatus for metal collection and particularly for collecting selective metals such as aluminum. The apparatus includes means for performing diagnostics through the use of a smart digital controller. The teachings of this application are hereby incorporated by reference herein. The apparatus disclosed therein had several limitations. First, field results have indicated that the apparatus does not adequately weigh the deposited material under all conditions. It has been shown that under the best conditions, the apparatus set forth in the Miller patent will weigh an accuracy of no greater than 95 percent; however, many weights and measure codes require a greater accuracy such as at least 98 percent. Furthermore, field failure of the scale dump solenoid has resulted in a failure to compensate a depositor for cans deposited in some instances. The existing system requires a great deal of service and maintenance and throughput is somewhat limited. Furthermore, the existing systems do not permit the addition of new features without relatively complex changes in the components within the existing controllers.

Untrained service personnel tend to operate the system in such a manner as to damage the solid state relays and there is a tendency on the part of maintenance personnel to calibrate the system even when calibration is not required. Furthermore, the system had no mechanism for ensuring that the payout was equal to the advertised price per pound and an additional problem detrimental to the total operation of the system is that it can accept non-metallic objects which are lighter than cans or within the general weight-size profile of an aluminum can, such as milk cartons, small plastic bottles and the like which can be readily processed and payed for by the present apparatus.

The next step in the evolution of selective scrap metal collection systems was disclosed in U.S. Ser. No. 463,573, filed Feb. 2, 1983 now U.S. Pat. No. 4,499,984 by the present inventors and assigned to the assignee of the present invention. This patent teaches an improved metal collection apparatus for collecting selective metal such as aluminum primarily in the form of used aluminum cans and for compensating depositors of such metal cans based on the weight of the selected metal collected. The collecting apparatus is free-standing and is designed to function unattended. The apparatus is provided with a hopper into which depositors place material, including aluminum cans, which the machine is designed to collect, the depositor then pushes the start button in the vicinity of the hopper to initiate operation of the apparatus. The deposited materials are carried from the hopper to a classifier by means of an endless conveyor belt and the classifier segregates magnetic or ferrous material from the non-magnetic materials. A pneumatic conveyor conveys aluminum cans to a crusher. The more dense non-magnetic materials collect in the bottom of the bin provided in the pneumatic conveyor and the aluminum materials is conveyed by the conveyor of the classifier to the crusher where the material is crushed so as to be more compact and to occupy significantly less space when stored. After passing through the crusher, the crushed material is weighed and its weight noted. The crushed material is then dumped into a stacker conveyor which transports the crushed aluminum cans to a storage bin in which they are stored until forwarded to a recycling plant. A digital electronic controller is provided to control the energization of the motors that drive the conveyors and the crusher and to provide power to the classifier. The weigher produces an analog signal that is digitized by an analog-to-digital converter, causes the compensation dispenser to dispense or disperse an appropriate amount of compensation in the form of coins or possibly even tokens. The apparatus is provided with motor alarm circuits which produce an alarm signal if any one of the motors is not running properly when energized, and the coin dispensing apparatus will produce an alarm signal if no coins or tokens are available to be dispensed. A detector is provided which produces an alarm signal each time a piece of magnetic material, such as a steel can or tin-plated steel can, is segregated from the materials deposited. An alarm signal will also be produced when the container or receptacle which receives these materials is full. Another detector is provided which produces an alarm signal if a jam occurs in the classifier conveyor since such a jam will prevent aluminum cans from being fed to the crusher. The electronic controller also includes circuit means for automatic calibration of the weighing system which is used to measure the weight of the aluminum cans deposited therein to assure that it is accurately weighing the material dumped. The digital electronic controller adjusts the set gain of the system such that the output of the weighing system is well within the range of the analog-to-digital converter. The autocalibration is updated continuously between cycles which results in optimum performance of the weighing system. In addition to this calibration, the load cell is initialized with a load-to-voltage-out reference resistor. Thus, replacement of the load cell or controller, changes in temperature, or variations in the power supply will not effect system accuracy. In addition to these features, the system is designed to reduce service in the field to an absolute minimum and built-in test features allow for easy and rapid troubleshooting. The system has an improved cycle time which is accompanied by increasing the weight of the bucket before stopping from 0.75 pounds to 1.5 pounds. Thus, the throughput of the apparatus is increased from 150–200 pounds per hour to 300–400 pounds per hour. To facilitate service and operation, retest features are incorporated which periodically reject all failed conditions. This system is capable of detecting operation of the scale-dump solenoid and the controller uses its knowledge of weight to detect whether the scale door is open. Other features include apparatus relating to the security of the money paid out such that the compensation rate is not set as previously done, with thumb wheel switches but in a non-volatile memory which provides an account of money and poundage and remembers the quantities even if power fails or is turned off. All solid state output devices are protected by short circuit protection circuitry to protect driver devices, and the error rate in weighing is less than one percent due to altering the sequence of operation and utilizing an improved bucket arrangement.

The next step in the evolutionary process is described in U.S. patent application Ser. No. 518,148, filed July 28, 1983, now U.S. Pat. No. 4,597,487. Many of the prior systems, however, still suffer from one or more shortcomings. Some do not provide for collection of re-claimable material using an adjustable but accurate pay out means for compensation which includes a customer display of both the weight of the collected reclaimable material and the money paid out. Prior systems do not generally provide a means for separating out ferrous materials magnetically and then separating heavy's and non-metals from non-ferrous metallic materials. Prior systems still generally pay for small plastic bottles and many glass and paper products. Prior systems do not generally display the weight of the contents of the material to the operator or depositor while he is putting the material into the apparatus and none appears to provide an accuracy good to 0.01 pounds. The prior systems do not have internal counters or memories that keep track of the poundage and the compensation to the nearest hundredth of a pound and the nearest penny for compensation, and none of the systems of the prior system provide any real self-testing or auto test modes of operation to assist in troubleshooting and the like. Most do not have an error re-test feature to minimize down time, and a second metal detector to determine the presence of non-ferrous metallic materials. No prior systems use of a heavy detector whose operation depends on how far a door or platform is moved or displaced when material falls on it. No prior system pays only in quarters or the largest coin denomination until the end of the operation when it pays the remaining compensation in smaller coins, as required. None has the ability to stop the crusher to prevent cans from coming into the bucket during the weighing operation and to provide an apparatus that has a continuous input feed. None of the present devices are self-adjusting so that the operator or depositor never has to make any adjustment such as zeroing, calibration or metal sensing. A need was therefore felt for a scrap metal collection system similar to the system described in copending U.S. patent application Ser. No. 518,148 filed on July 28, 1983 now U.S. Pat. No. 4,597,487 and invented by the inventors of the present U.S. patent application.

SUMMARY OF THE INVENTION

It is an object of the present invention to provide an improved scrap metal collection apparatus.

It is yet another object of the present invention to provide a scrap metal collection apparatus for separating ferrous and excessively heavy materials from the non-ferrous metallic materials.

It is still yet another object of the present invention to provide an improved scrap metal collection apparatus wherein the operation of the apparatus is controlled by a central controller.

It is a still further object of the present invention to provide a scrap metal collection apparatus in which compacted materials are mechanically distributed throughout a storage volume.

It is a further object of the present invention to provide a scrap metal collection apparatus in which the lugs on a crusher wheel are staggered to improve a compaction operation.

It is still a further object of the present invention to provide an improved scrap metal collector to provide guides for the conveyor belts.

The aforementioned and other objects are accomplished, according to the present invention, by a scrap metal collection apparatus that separates a selected material, e.g. aluminum, weighs the selected material and compensates the person depositing the selected material according to a pre-determined rate per unit weight of the material. The scrap metal collection apparatus separates ferrous materials, materials exceeding a certain weight, and non-metallic materials from the target material. The material is compacted prior to weighing and, following the weighing procedure, is distributed through a large storage volume. The identification of the excessively heavy material is accomplished by allowing the material to fall against a plate, the movement of the plate activating a switch when a material exceeding a predetermined weight impacts the plate. The plate is implemented in a manner to minimize conveyor jamming of the input conveyor belt. The material detected as being excessively heavy is deflected by a door having a latch arrangement. The compacted material distributing apparatus includes a distributor wheel with a plurality of arms for projecting the compacted material into the storage volume. To prevent vibration and provide a more uniform feed to the compacting apparatus, a crusher wheel is provided with lugs not extending across the entire compacting surface of the wheel. Tracking guides are placed on the conveyor belts to minimize undesired sideward movement of the belt. In order to minimize damage to the system, time-out features are included by the control apparatus. The control apparatus also provides initialization function, pay-out features, and multiple input signals to monitor and control the operating cycle.

These and other features of the present invention will be understood upon reading of the following description along with the drawing.

OPERATION OF THE PREFERRED EMBODIMENT

Detailed Description of the Drawings

Figure 1:
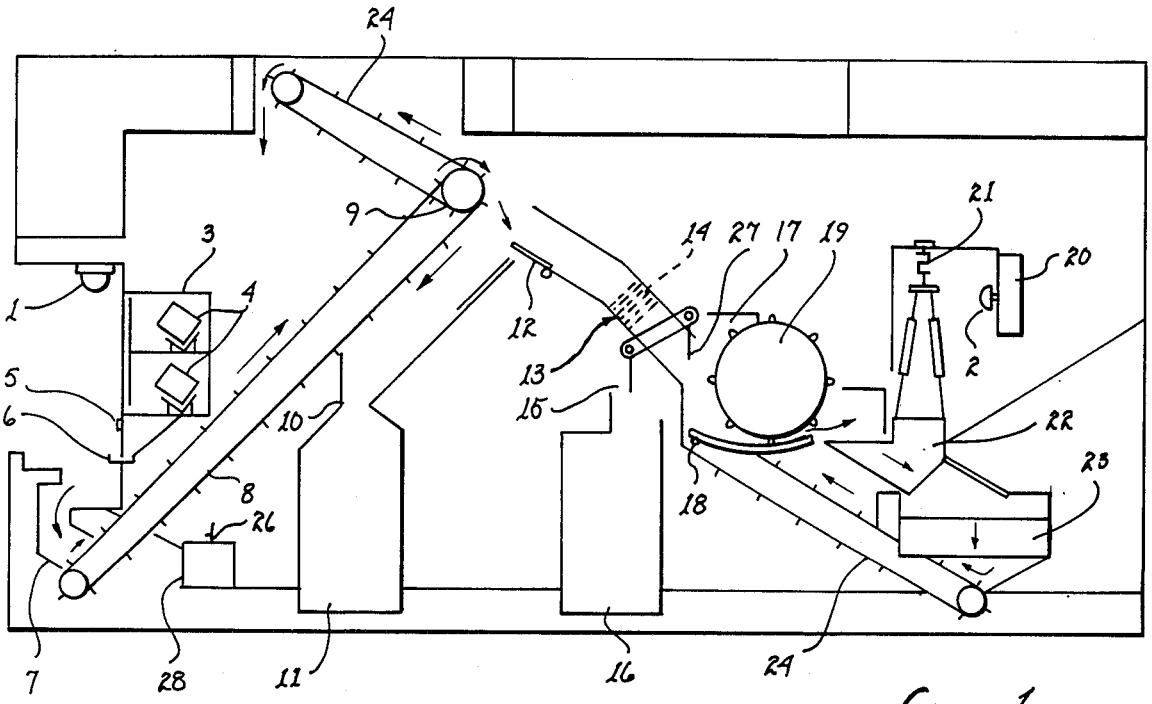
FIG. 1 is a cross-sectional diagram of the container collection system of the initial invention.

Referring to FIG. 1, a diagram of the scrap metal collection system is shown. A utility light 1 illuminates a front portion of the collection system. Operation of the machine is initiated by pressing start button 5. Payment for the scrap metal is delivered from coin drums 4 in vault 3 to coin cup 6. The scrap metal is deposited in input chute 7 that deposits the scrap metal on the input conveyor 8. The scrap metal proceeds past magnet pulley 9. Ferrous materials are deposited in steel storage bin 11 after passing steel metal detector 10. Non-ferrous materials are deposited in heavy metal door 12 and conducted past classifier assembly 13 and metal detector 14. Drop door 15 in conjunction with deflector door 27 deposits material with excessive weight or non-metallic materials in the heavy and non-metal materials storage 16. The remaining materials are placed in the crusher input hopper and compacted between crusher plate 18 and crusher wheel 19. The compacted materials are deposited in weight bucket 22 and the weight determined by load cell 21. The materials from the weight bucket 22 are deposited first in scale exit storage hopper 23 and then onto storage conveyor 24. The selected scrap materials are distributed in storage bin 25. The scrap materials are removed from the exit duct 28 with the assistance of agitator 26. The scrap metal collection system is operated under control of controller 20. An intrusion alarm 2 is present.

Figure 2:
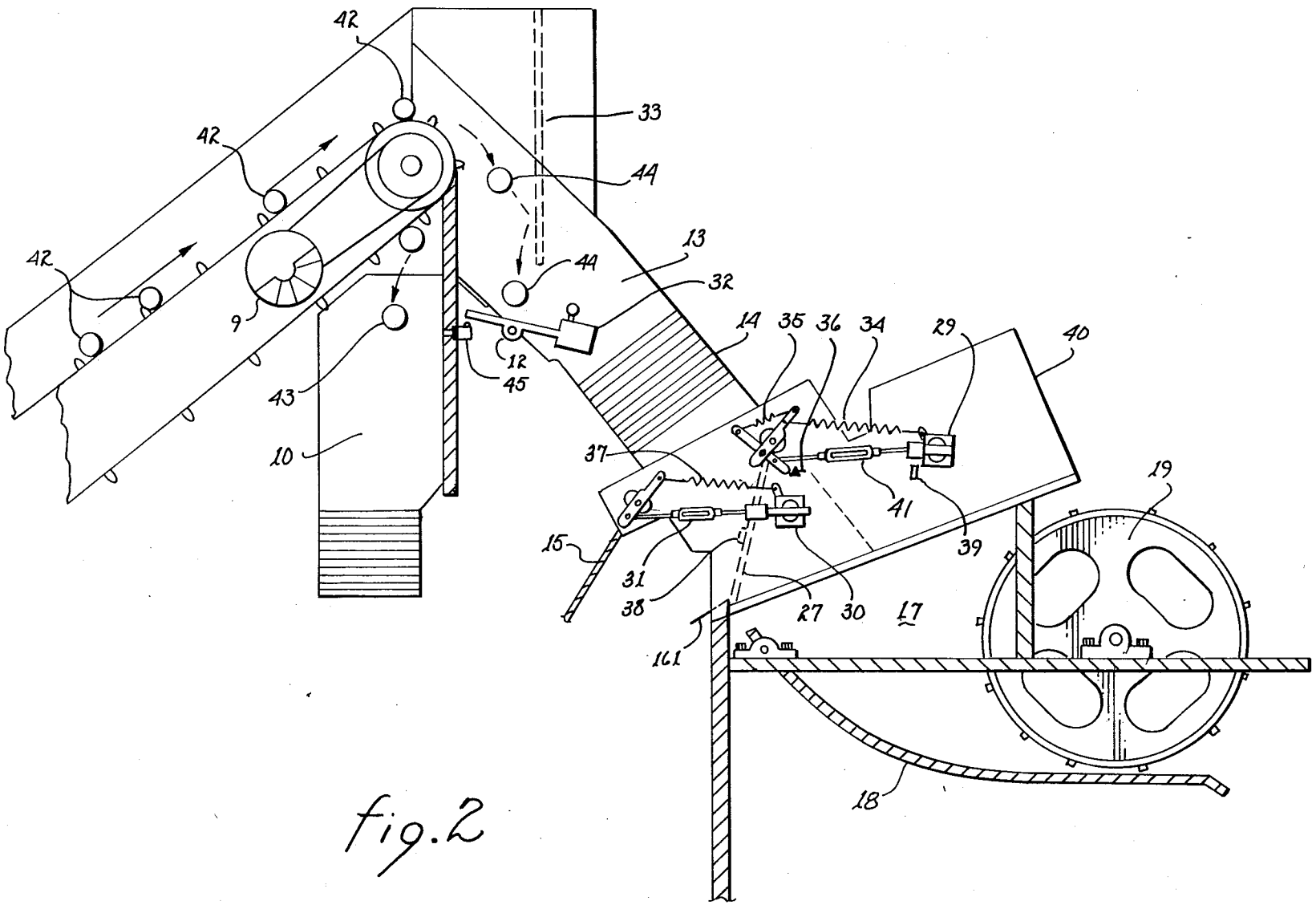
FIG. 2 is a detailed cross-sectional diagram of the classifier apparatus of the container collection system.

Referring to FIG. 2, a more detailed diagram of the scrap metal selection apparatus for the scrap metal collection system is shown. Incoming cans 42 are transferred via input conveyor 8, driven by magnet pulley 9, and guided by the heavy metal detector deflector 33. Steel cans 43 are transferred past steel metal detector 10. Aluminum cans 44 are lead past metal detector 14. The heavy and non-ferrous materials are deflected from the main path by drop door 15 when closed drop door 15 engages ledge 161. A drop door restoring spring 37 and a drop door turnbuckle 31 are coupled to the drop door 15. Drop door solenoid 30, along with the stop for the drop door solenoid 38, control the position of the drop door 15. The deflector door 27 is controlled by the deflector door solenoid 29, restoring spring for the deflector solenoid 34, the latch spring for the deflector solenoid 35, latch for the deflector door 36, the deflector door turnbuckle 41, and the stop for the deflector door solenoid 39. Plate 40 secures the drop door apparatus and the reflector door apparatus. The heavy door weight 32 controls the weight of material needed to activate heavy door switch 45.

Figure 3:
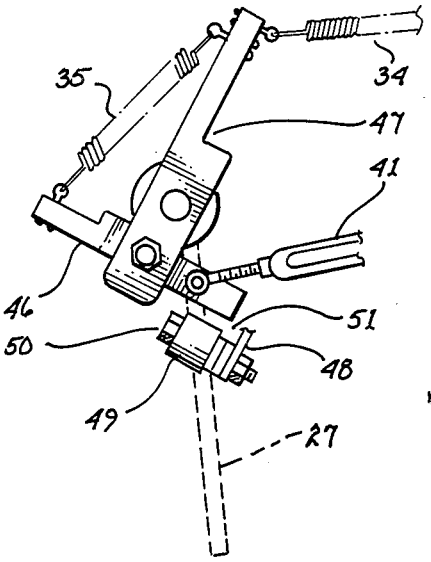
FIG. 3 is a cross-sectional view of the detector door mechanism.

Referring to FIG. 3, a detailed diagram of the deflector door apparatus is shown. The deflector door 27 has the deflector door rotating arm 47 coupled thereto. Deflector door rotating arm 47 has deflector door restoring spring 34 and latch restoring spring 35 coupled thereto. Deflector door pivot arm 46 is coupled to deflector door rotating arm 47, to latch restoring spring 35 and turnbuckle 41 coupled thereto. Stop for latch 48, spacer 51, screw 50 and holder on plate 49 are shown.

Figure 4:
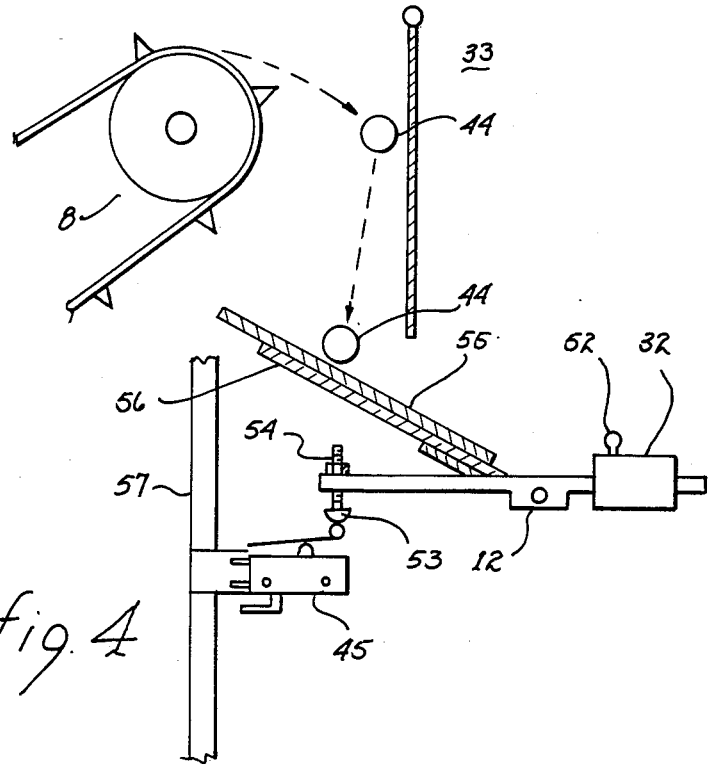
FIG. 4 is a schematic cross-sectional view of the heavy detector system.

Referring to FIG. 4, a detailed diagram of the heavy material detection scheme is shown. The non-ferrous materials 44 are conveyed by input conveyor 8, strike deflector drape 33 before impacting soft belt material 55. The soft belt material 55 is coupled to hard polystyrene material 56. The hard polystyrene material 56 is coupled to heavy detector door 12. The heavy detector door 12 has an adjustable heavy weight 32 with a thumb screw 52 and a heavy detector adjusting screw 53 with locking nut 54 coupled thereto. A stand 57 is provided to hold the assembly including heavy material switch 45 in place.

Figure 5:
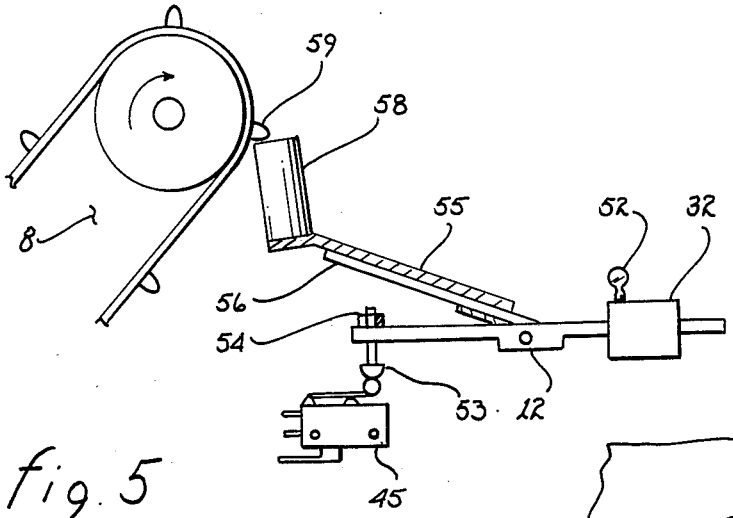
FIG. 5 is a schematic cross-sectional view of a can position jamming the input conveyor belt.

Referring next to FIG. 5, the situation wherein a stuck can 58 can cause a jam is illustrated. The use of the flexible belt material 55 and bent lug 59 of the conveyor belt in preventing jams is also illustrated.

Figure 6:
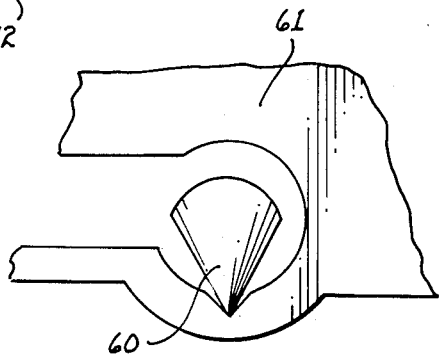
FIG. 6 is a cross-sectional diagram indicating how the heavy detector lever arm is supported.

Referring next to FIG. 6, the shaft 60, coupled to heavy metal detector door 12 for rotation, in its relative interaction with classifier body 61, is shown.

Figure 7A:
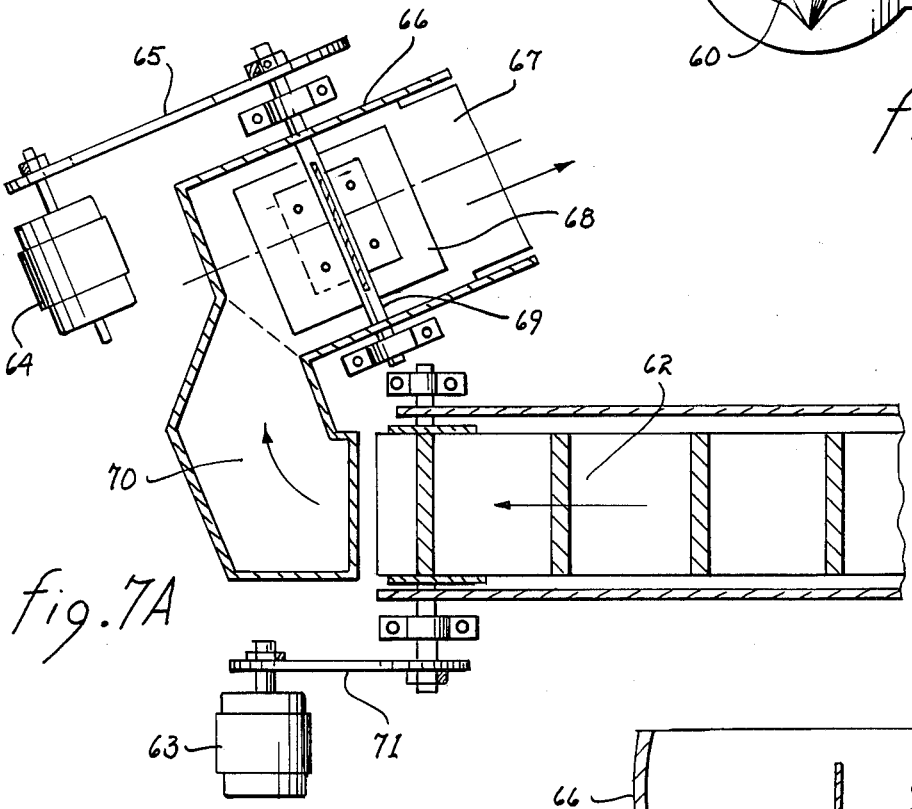
FIG. 7A is a top view of the airless can distributor.

Referring to FIG. 7A, the scrap metal distributor is shown. Storage conveyor 62 (or 24) is driven by conveyor gear motor 63 and chain drive 71 and delivers crushed materials to the materials distributor input chute 70. Housing 66 and adjustable housing end 67 guide the materials for distributor 69. Distributor 69 has belt material arms 68 and is driven by material distribution motor 64 and belt drive 65.

Figure 7B:
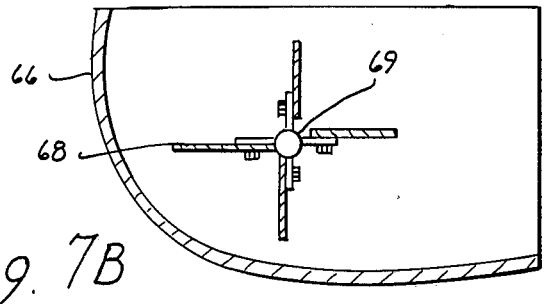
FIG. 7B is a cross-sectional view of a section of the airless can distributor.

FIG. 7B shows a cross-sectional view of distributor housing 66 and distributor 69 along with distributor belt arms 68.

Figure 8A:
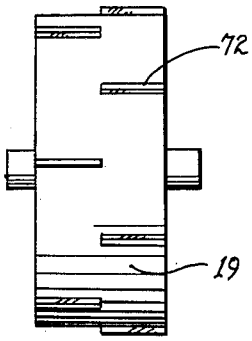
FIG. 8A is a front view of the crusher wheel.
Figure 8B:
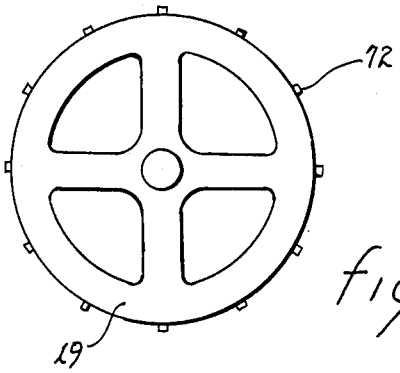
FIG. 8B is a side view of the crusher wheel.

Referring to FIG. 8, the staggering of crusher wheel lugs 72 on the crusher wheel 19 is illustrated.

Figure 9:
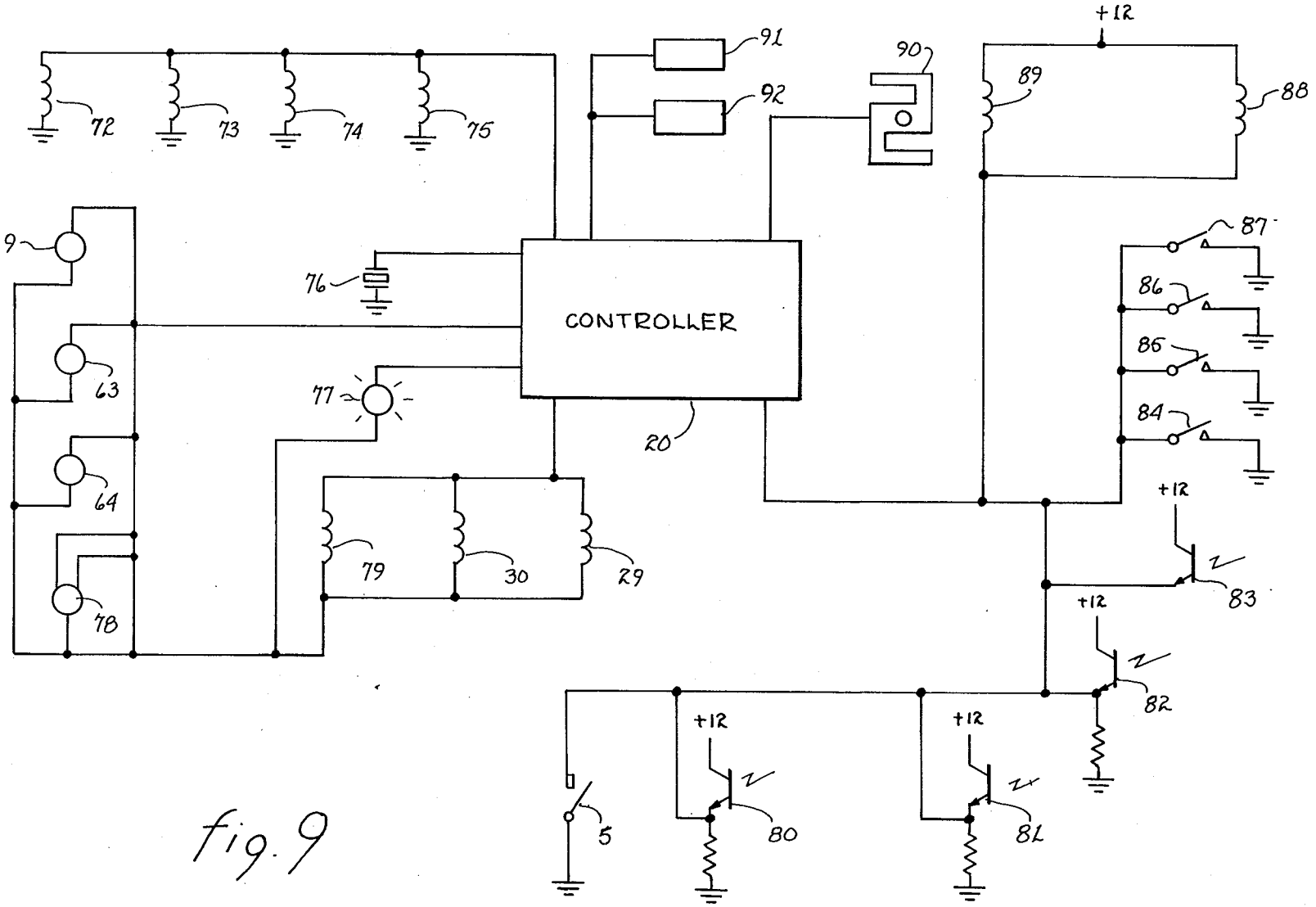
FIG. 9 is a schematic electrical diagram of the control apparatus of the container collection system.

Referring to FIG. 9, apparatus electrically coupled to controller 20 are shown. The controller 20 is coupled to penny dispenser 72, nickel dispenser 73, quarter dispenser 74, and token dispenser 75. The controller is also coupled to steel can alert apparatus 76, out-of-money light 77, the crusher motor 78, the material distributor motor 64, the storage conveyor motor 63, the input conveyor motor 9, the scale bucket solenoid 79, the drop door solenoid 30 and the deflector door solenoid 29. The controller 20 receives signals from start switch 5, token top detector apparatus 80, quarter top detector apparatus 81, nickel top detector apparatus 82, penny top detector apparatus 83, door open apparatus 84, storage conveyor motion detector apparatus 85, input conveyor motion detection apparatus 86, heavy material detection apparatus 87, metal detection coil 88, steel can detector coil 89 and load cell 90. The pounds of material display 91 and the money dispensed display 92 are controlled by controller 20.

Figure 10A:
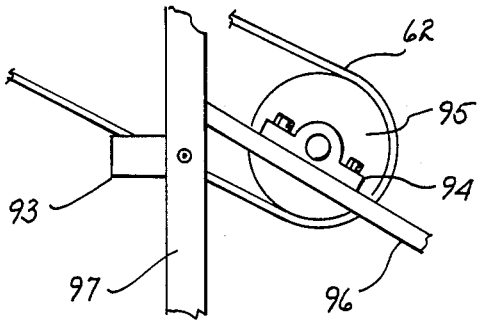
FIG. 10A is a side view demonstrating the position of the belt guide with respect to the pulley.
Figure 10B:
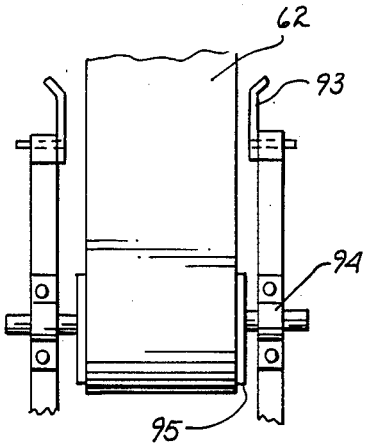
FIG. 10B is front view demonstrating the position of the belt guide with respect to the pulley.

Referring to FIG. 10A and FIG. 10B, the drawings show where belt guides 93 are located with respect to conveyor belt 62. The conveyor belt 62 is moved over pulley 95. Pulley 95 is supported by pillow block 94. Pillow block 94 is, in turn, supported by pillow block mount 96 which is supported by conveyor support 97.

Figure 11A:
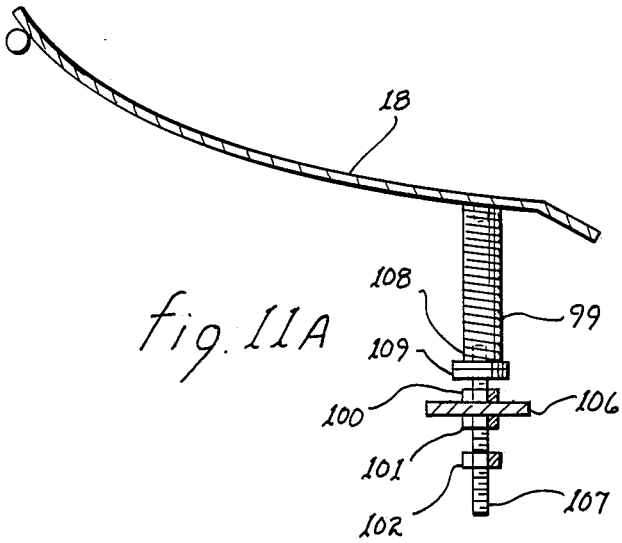
FIG. 11A is a side cross-sectional view of adjustment mechanisms for the crusher assembly.
Figure 11B:
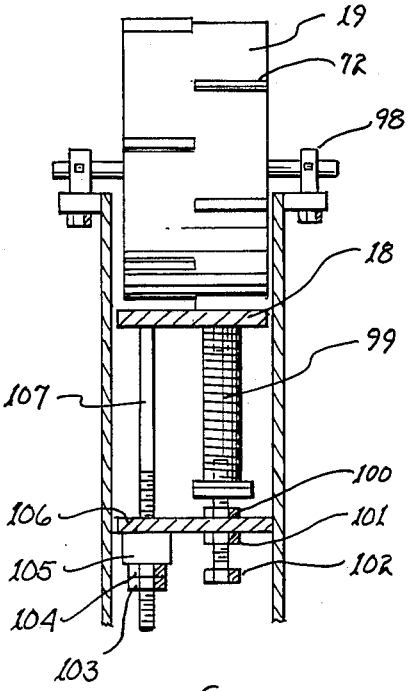
FIG. 11B is a front cross-sectional view of adjustment mechanisms for the crusher assembly.

Referring next to FIG. 11A and FIG. 11B, the arrangement for adjusting the distance between the crusher plate 18 and the crusher wheel 19 (with lugs 72 associated therewith) is shown. Crusher wheel 19 is supported by pillow block 98. Crusher spring 99 contacts crusher plate 18, collar 108, washer 109, spring support 106, upper locking nut 100, lower locking nut 101 and adjustable screw 102. Crusher plate 18 is also in contact with adjustable rod 107 which is supported by spring support 106 in conjunction with shock mount 105, locking nut 103 and locking nut 104.

Operation of the Preferred Embodiment

Referring to FIG. 1 and FIG. 2, operation of the container collection mechanism is initiated when start button 5 is pressed. Operation of the input conveyor mechanism 8 and the storage conveyor mechanism 24 begins immediately thereafter. The system controller 20 automatically adjusts and calibrates the weighing system and metal detector system 14. The pounds of material display and the money exchanged for the material display are initialized (i.e. to all zeros).

As cans 42 are fed into the input chute 7, they are conveyed by the input conveyor mechanism 8 over the magnetic drum pulley 9, and from there through the classifier chute 13. At this point only non-ferrous material 44 is present. A deflector 33 at the entrance guarantees that the material as it enters the classifier assembly 13 travels over the heavy detector and that pre-flattened material will slide down the bottom edge of the classifier assembly 13. Material in the classifier assembly 13 moves past the second metal detector 14 where the non-ferrous metal (aluminum) is detected. At this point, any materials which are not metal, or are too heavy, are diverted by deflector door 27 and drop door 15 into heavy and non-metal storage container 16. If metal (aluminum) is detected by metal detector 14, then deflector door is opened and drop door 15 is closed. This arrangement directs the deposited aluminum cans into the crusher input hopper 17. The crusher wheel 19, which was turned on after auto-zero and calibration, compacts the cans to 5 to 7 pounds per cubic foot and deposits them into the weight bucket 22.

As the cans are being deposited into the weight bucket 22, the weight of the material is monitored. When the weight of the material reaches 1.2 pounds, or if an elapsed time of 20 seconds has passed since metal has been detected at the metal detector 14, or if no increase in bucket weight is achieved in 30 seconds, the crusher 19 stops and the metal in the bucket is processed.

After the weight is reached, or if time-out occurs, then a final weight of the bucket 22 and its contents is determined. The contents are then dumped and after a suitable stabilizing delay, the empty bucket 22 is again weighed, while the dumped cans are conveyed to storage. The system controller 20 processes the difference between the weight bucket 22 with and without the metal contents to determine the exact weight of the material. The compensation in the form of coins delivered to coin cup 6 is based on this weight.

At no time during the normal process of accepting cans does the input conveyor 8 stop. However, the crusher 19 is stopped when the weight of the weight contents is being computed. During the time that the crusher 19 is stopped, incoming cans are temporarily stored in the crusher input hopper 17. When crusher 19 starts, it immediately crushes these cans and dumps them into the weight bucket 22 for weighing. This process continues as long as cans are being fed into the input chute 7.

Cans are dumped from the weight bucket 22 into a scale exit hopper 23 that deposits them onto the storage conveyor 24. The storage conveyor 24 travels in the opposite direction of the inlet conveyor 8, and dumps the cans into the storage bin 25 via the can distributor.

Each time a new weight of cans is processed, the front panel display will show the customer his new total weight. As a payout amount of one quarter is computed, it is paid out to the customer and is also displayed on the front panel. During a processing cycle, the payout and weight will not necessarily correspond. However, at final payout the weight received times the rate to be compensated per pound will agree with the payout amount on the display; except the payout is always rounded up to the nearest penny. When activity ceases and the cycle ends, the final payout sequence is initiated. The motors shut off, remaining tenths and hundredths of pounds will be displayed, and the final payout is made.

The entire sequence is controlled by the system controller 20, a sophisticated electronic module consisting of a MPU board, a power board, a keyboard, a mother board, a high voltage control board and two external display boards.

An exit blower system is provided to unload the machine. After the side doors are opened, the exit duct 28 is extended to a position over a transport vehicle. Switch A starts the blower and sends cans through the exit duct 28. Next, Switch B starts the agitator 26 that meters cans into the blower's air stream until the machine is empty. Switch B should be opened before Switch A is opened, to stop the exit operation to prevent cans from jamming the exit duct 28.

If the machine malfunctions or fails to operate properly, then the customer is informed of this by an OUT OF MONEY light.

A closer look of the classifier assembly 13 is provided in FIG. 2. As the non-ferrous material enters the classifier assembly it is deflected downward by a deflector 33 onto the heavy detector door 12. The non-ferrous material then slides down the classifier chute and through the second metal detector 14. When the heavy detector is not tripped, the metal detector senses the material using the controller. When metal is present without heavy material detection, the drop door 15 is closed and the deflector 27 is opened allowing the non-ferrous metal material to enter the crusher input hopper 17. After a suitable delay, the drop door 15 opens and the deflector door 27 closes. These doors are restored to their dormant position using a restoring spring 37 of the drop door 15 and a restoring spring 34 on the deflector door 27. Spring 35 is used to latch the deflector door so that heavy objects striking it will be deflected out rather than through to the crusher 19.

One part of the latch is built into the plate 40, the other part is better understood from FIG. 3. As it can be seen, when pressure is applied against deflector door 27, pivot arm 46 is driven into stop 48 preventing the door from opening. When the solenoid 29 pulls the pivot arm 46, it rotates counterclockwise to line up with deflector door turnbuckle 41 and deflector door solenoid 29. This arrangement causes the pivot arm to clear latch 48, thereby allowing the deflector door 27 to open. The deflector door 27 is rotated about Point A. As the solenoid is de-energized, Point A rotates clockwise and is restored to its original position by spring 34. Pivot arm 46 is restored to the latched position by spring 35.

FIG. 4 is an exposed view of the heavy material detector system. The heavy material detector is attached to the heavy detect arm 12. The heavy detect arm is allowed to rotate freely about Point B. This assembly is a counter balanced weight system set to discriminate course weights. The balance is provided by weight 32. It is adjusted by loosing thumb screw 52 and sliding the weight on heavy detector bar 12. As non-ferrous material is received from the input conveyor, the material comes into contact with deflector drape 33 causing the non-ferrous material 44 to fall onto the heavy detector plate. The heavy detector plate is made up using a polystyrene plate 56 and belt material 55. Two inches of the end of the polystyrene has been eliminated thereby exposing the belt material 55. The exposed belt material provides a soft end that is flexible. This flexible end prevents can jams between the input conveyor 8 and the heavy detector plate 55, 56. When material that is heavier than the set limit determined by adjustable heavy weight 32 is received, Point B rotates counter-clockwise a sufficient amount to trip heavy material microswitch 45, thereby providing a heavy detect signal. This signal alerts the control system that a heavy has been received and that it should be rejected through the drop door.

FIG. 5 shows how a can can stick to the input conveyor belt 8 causing a jam. this jam can be eliminated by using the flexible belt 55 material. Both the lug on the input conveyor 59 and the end of the belt material 55 on the heavy detector are capable of flexing. However, the lug 59 cannot flex enough to prevent a jam. The addition of the belt material on the end of the heavy detector plate makes this area virtually jam proof.

FIG. 6 shows how the shaft has been cut to make the counter-lever action about Point B uniform and almost friction free.

Referring once again to FIG. 2, a ledge 161 is shown added to the closure area of the drop door 15. This ledge prevents partially mashed cans from jamming and falling out of the heavy drop door. This condition occurs because of large mechanical leverage on the door swing causing the solenoid to bounce when closure occurs.

FIG. 7 shows how the airless can distributor operates. As crushed cans are conveyed up storage conveyor 24, they are dumped into a hopper 70 where they slide into the tray of the can distributor. The rotating paddle picks up the cans and slings them to the rear of the scrap metal collection system. The angle at which the cans leave the can distributor is dependent upon the adjustment of the lower plate 67 of the can distributor. The paddle wheel 69 is driven by a motor 64 through a belt drive 65. This belt drive arrangement reduces the paddle wheel speed to a reasonable speed of about 600 RPMS. This speed is adjustable by changing a pulley. The speed of the paddle wheel determines how far and with what velocity the cans leave the can distributor.

Most of the paddle wheel is made out of belt material 68 so that can jams will not occur and that all cans will fall into the storage bin. However, if for any reason the can distributor does not distribute cans, an overflow arrangement has been incorporated such that the conveyor belt transports the cans, allowing them to fall into the storage bin.

FIG. 8 shows how the crusher plate has been redesigned with staggered lugs. Staggered lugs have been used to prevent cans from rhythmically bouncing at the entrance to the crusher. With this crusher arrangement cans are continually processed by the crusher.

FIG. 9 is an electrical diagram of the control system of the scrap metal collection system. The output signals from the controller 20 control penny dispenser 72, nickel dispenser 73, quarter dispenser 74 and token dispenser 75, a steel can alert 76, "OUT OF MONEY" light 77, input conveyor motor 9, storage conveyor motor 63, can distributor motor 64, crusher motor 78, scale bucket solenoid 79, drop door solenoid 30, deflector door solenoid 29 and two displays (i.e. for pounds of material 91 and for dollars and cents deliverer 92).

The input signals to the controller are the coin top detect signals (penny holder 83, nickel holder 82, quarter holder 81 and token holder 80), load cell 92, steel can detector coil 89, classifier metal detect coil 88, heavy detector switch 98, input conveyor motion detector 86, storage motion detector 85, open door switch 84 and start switch 5. The controller 20 can be implemented by a microprocessor control system. The controller 20 uses available input data to analyze the operation status and based on this information, output signals are provided by the controller 20 to produce the appropriate response.

By way of example, when start switch 5 is activated, a closure to ground causes the controller 20 to enter a pre-established an operational cycle. Immediately the input conveyor 9, the storage conveyor 24 and the can distributor 64 are energized. Also, the activation of the start switch 5 establishes a reference for the steel can and metal detector oscillators and the displays 91 and 82 are balanced. Prior to turning on the crusher 28, an auto-adjust of the load cell and a calibration is accomplished. After calibration, the controller turns on the crusher 78. The controller then sets a time delay of 30 seconds and goes into an evaluation mode looking for input signals from the motion detector, the heavy detector, the timer, and the weight change from the load cell. Each input is appropriately acted upon. When a heavy material is detected, heavy detect switch 87 is closed which, via the controller, forces the drop door solenoid 30 and the deflector door solenoid 29 to be de-energized until the heavy material has fallen out the door. Motion detector switches 85 and 86 are sampled over a timing period. Should a pre-determined number of counts not be received on either one of these detectors, then a shut down cycle is entered. The conveyors are cut off and then turned back on. If the error still persists then an error alarm is produced and the collection system shuts down. The system shuts down when weight is not added to the weight bucket after a predetermined period of time.

The controller includes a signal storage mechanism that can be initiated when the OUT OF MONEY light is initiated or by other selected activity and stores the time of inactivity of the system (i.e. downtime) for verification of maintenance.

The classifier metal detector coil 88 is combined in the controller to complete an oscillator circuit that allows processing of frequency data to determine when a piece of non-ferrous metal is received. Each time non-heavy metal is detected, the drop solenoid 30 and the deflector solenoid 29 are energized allowing the material to be crushed. As the doors are opened the reference valve for the metal detector is updated. Because of the drift of the metal detector oscillation, the oscillator by the controller 20 is re-initialized each time the deflector door and the drop door are open. This re-initialization ensures the proper relationship between door activation and detection of a metal object.

The system includes the addition of belt guides which prevent the input conveyor and the storage conveyor from walking to one side or the other during operation. FIGS. 10A and 10B show where these guides are placed with respect to the conveyor belt 62. The lower pulley 95 is coupled onto the pillow block mount 96 which is coupled directly to the frame of the machine by pillow blocks 94. The belt guides are mounted to frame support 97. The belt guides are constructed using polypropylene material. This material is smooth surfaced allowing the belt edge to slide freely against it. When the belt rides over and into contact with the guides, pressure against the belt prevents further travel thereby preventing the belt 62 from walking off the end of the pulley 95.

In FIGS. 11A and 11B, the apparatus for adjustment of tension on the crusher plate 18 and the spacing between the crusher plate 18 and the crusher wheel 19 is shown. The spacing is adjusted by loosing locking nut 103 and then either loosing or tightening locking nut 104. These adjustments cause the position of the crusher plate 18 to be moved closer to or further away from the crusher wheel 19. This is accomplished using adjustable rod 107 which is welded to the crusher plate 18. Pressure is applied to the plate using spring 99. In operation, the shock mount 105 prevents over-travel of the crusher plate 18 which would allow it to engage the crusher wheel 19. The stiffness of the plate 18 (tension) is adjusted using screw 102. It is held in place by the upper locking nut 100 and the lower locking nut 101. These locking nuts allow for the adjustment of screw 102 which is fitted into a collar 108. The collar supports the spring allowing for more tension to be placed against the crusher plate 19 or less tension as desired. Frame member 106 is firmly welded in place and acts as the other stress point between the crusher plate 18 and the screw 102, collar 108, locking nuts 100 and 101, combination.

The system includes a method of updating the reference value of the metal detector during the operating cycle; the use of an additional feature of the increase of the weight in the bucket for time-out purposes; the incorporation of a non-volatile downtime timer for maintenance and operational purposes.

The updating of the reference value for the metal detector is accomplished by recognizing that when the deflector and the drop doors open, no metal could be present in the metal detector. To assure optimum update, metal detector values are remembered for five sample times in a push down stack. The oldest value is always used for update which means that the operation of the metal detector must have been dormant just prior to the opening of the doors. In reality, the fifth back value is about 140 milliseconds before the doors open.

The monitoring of the bucket weight increase as a function of time is accomplished by using a 30 second timer which is set as the search loop for cans in the bucket is entered. Each time the analog to digital converter is read, the new weight is compared to the existing weight. Each time the new weight exceeds the old weight by 0.02 lb. the 30 second timer is re-initialized.

The downtime timer is active anytime the "OUT OF MONEY" light is illuminated. Its timing is achieved using the 60 Hz line. It is therefore accurate to the accuracy of the input 60 Hz. It counts in one-minute intervals and has a capability of 99.59 hrs. The non-volatile memory is used for storage of the timer values. Provisions have been made from the controller keyboard to reset this timer to all zeros.

The above description is included to illustrate the operation of the preferred embodiment and is not meant to limit the scope of the invention. The scope of the invention is to be limited only to the following claims. From the above discussion, many variations will be apparent to one skilled in the art that would yet be encompassed by the spirit and scope of the invention.

What is claimed is:

1. The method of controlling a scrap metal collector apparatus comprising the steps of:

activating said collection apparatus when a start button is manipulated, said activation step causing a signal processor to activate an input conveyor apparatus, said input conveyor apparatus separating ferrous materials from non-ferrous materials;

providing an activation signal to said processor when a non-ferrous material exceeds a pre-determined weight;

opening a door mechanism by said signal processor when said activation signal is received;

providing a detection signal to said signal processor when a non-ferrous metal object passes a metal detector;

closing said door mechanism by said processor as a result of said metal detection signal;

transferring non-ferrous metallic metal to a storage bin having a weighing mechanism associated therewith;

providing said signal processor with signals related to a weight of material in said storage bin; and dispensing coins having a predetermined relationship with said weight related signals.

2. The method of controlling a scrap metal collection apparatus of claim 1 further including the step of:

storing periodic timing signals after a pre-selected condition defining lack of operation of said collection apparatus, said timing signal defining a downtime for said collection system.

3. The method of controlling operation of a scrap metal detection system of claim 1, further comprising the step of initializing operation of an oscillator comprising part of said metal detector each time said door mechanism is activated.

4. The method of controlling operation of a scrap metal detection system of claim 1 further including the step of ceasing operation of said system when said signal processor determines a weight has not been added to said storage bin for a determined period of time.

5. The method of controlling operation of a scrap metal detector of claim 1 further including the step of ceasing transferring of non-ferrous metallic material to said storage bin while said signal processor causes said non-ferrous metallic material in said storage bin to be weighed.

6. A scrap metal collection system comprising:

first means for separating non-ferrous material from ferrous materials, said first means includes a conveyer belt and magnetic pulley;

second means for separating non-ferrous materials having a pre-determined weight from a remainder of said non-ferrous materials, said second means comprising a plate of flexible material, said non-ferrous material dropping from said conveyer belt onto said plate, said plate preventing jamming of said conveyer belt;

third means for separating non-metallic material having the same weight from said remainder of non-ferrous material;

fourth means for determining a quantity of non-ferrous metallic material after separation by said first, said second and said third means; and fifth means for providing compensation dependant on said quantity of non-ferrous metallic material.

7. A scrap metal collection system comprising:

first means for separating non-ferrous material from ferrous materials;

second means for separating non-ferrous materials having a pre-determined excessive weight from a remainder of said non-ferrous materials, said second means including a door responsive to identification of said excessive weight non-ferrous material, said door conducting said excessive weight non-ferrous material to a material path, said second means including a latch mechanism for securing said door against impact of said excessive weight non-ferrous material;

third means for separating non-metallic material having the same weight from said remainder of non-ferrous material;

fourth means for determining a quantity of non-ferrous metallic material after separation by said first, said second and said third means; and fifth means for providing compensation dependant on said quantity of non-ferrous metallic material.

8. A scrap metal collection system comprising:

first means for separating non-ferrous material from ferrous materials, said first means includes a conveyer belt and magnetic pulley;

second means for separating non-ferrous materials having a pre-determined excessive weight from a remainder of said non-ferrous materials, said second means including a door responsive to identification of said excessive weight non-ferrous material, said door conducting said excessive weight non-ferrous material to a material path, said second means including a latch mechanism for securing said door against impact of said excessive weight non-ferrous material, said second means also including a plate of flexible material, said non-ferrous material dropping from said conveyer belt onto said plate, said plate preventing jamming of said conveyer belt;

third means for separating non-metallic material having the same weight from said remainder of non-ferrous material;

fourth means for determining a quantity of non-ferrous metallic material after separation by said first, said second and said third means; and fifth means for providing compensation dependant on said quantity of non-ferrous metallic material.

9. A scrap metal collection system as recited in claim 8, said system further comprising:

a compacting means for reducing a volume of non-ferrous material prior to operation of said fourth means, said compacting means including a crusher wheel and a crusher plate, said crusher wheel including lugs in staggered positions;

a means for halting material from reaching said compacting means when said fourth means is determining said quantity of non-ferrous metal.

10. A scrap metal collection system as recited in claim 8, said system further comprising:

a distribution means for mechanically distributing said quantity of material in a storage portion of said scrap metal collection system, said distribution means including a rotating wheel with an arm associated therewith for projecting said quantity of material into said storage portion.

11. A scrap metal collection system as recited in claim 8, said system further comprising:

a control means for providing initial conditions for said scrap metal collection system, said control means having means for halting operation of said scrap metal collection system for conditions including lack of motion of said conveyer belt, said control means having a restarting means to determine if said conditions persist, said control means being provided with a means for terminating operation of said scrap metal collection system after a predetermined elapsed time following a last operation of said fourth means.

12. In a scrap metal collection system for providing compensation when appropriate materials are deposited at an input chute, apparatus for controlling operation of said scrap metal collection system comprising:

processing means for providing control signals in response to status signals;

motors driving a conveyor for moving said deposited material at said input chute;

a ferrous metal detector coil for detecting ferrous material from material deposited at said input chute and being moved by said conveyer, said ferrous metal detector coil causing separation of ferrous material from non-ferrous material;

a non-ferrous metal detector coil for detecting non-ferrous metal from said non-ferrous material;

a deflector door solenoid;

a drop door solenoid, said deflector door solenoid and said drop door solenoid being activated by said non-ferrous metal detector coil upon detecting a non-ferrous metal to cause separation of ferrous material from non-ferrous metal material;

a crusher motor for driving a crusher that crushes said non-ferrous metal material;

a motor driving a cam distributor for distributing said crushed non-ferrous metal material;

a scale bucket solenoid for manipulating a scale bucket after receiving said non-ferrous metal material from said can distributor;

a weight determining means coupled to said scale bucket for determining when a preset weight is reach after receiving said non-ferrous metal material and for determining compensation for said non-ferrous metal material;

a display apparatus for displaying weight of said non-ferrous metal material;

a coin dispenser driven by a coin dispenser motor responsive to said weight of said non-ferrous material being displayed on said display apparatus;

apparatus means for providing separate status signals associated with:

detection of materials above a predetermined weight, operation of an input conveyer, operation of a storage conveyer, operation of said coin dispenser, operation of said ferrous metal detector coil, operation of said non-ferrous metal detector coil, and operation of said weight determining means for determining an amount of scrap metal remaining in said scrap metal collection system; and apparatus means for responding to control signals associated with said deflector door solenoid, drop door solenoid, scale bucket solenoid, conveyer motors, can distributor motor, coin dispenser motors, crusher motor and display apparatus.

13. The scrap metal collection system control apparatus of claim 12 wherein:

said crusher motor is deactivated for the purpose of temporarily stopping the flow of said non-ferrous material to said weight determining means while a final weight is being calculated by said weight determining means.

14. The scrap metal collection system control apparatus of claim 12 wherein:

activation of said drop door solenoid and said deflector door solenoid is determined by input signals from said detection of materials above a predetermined weight and from said non-ferrous metal detector coil.

* * * * *

UNITED STATES PATENT AND TRADEMARK OFFICE

CERTIFICATE OF CORRECTION

PATENT NO. : 4,787,495

DATED : 11-29-88

INVENTOR(S) : TUTEN et al.

It is certified that error appears in the above-identified patent and that said Letters Patent is hereby corrected as shown below:

In claim 12 line 24 after "driving a" delete "cam" and insert therefor --can--.

Signed and Sealed this

Eighteenth Day of April, 1989

*Attest:*

*Attesting Officer*

DONALD J. QUIGG

*Commissioner of Patents and Trademarks*